US005457820A

United States Patent [19]

Yielding

[11] Patent Number: 5,457,820

[45] Date of Patent: Oct. 17, 1995

[54] ATTACHABLE BIB, HOLDER, AND CATCH

[76] Inventor: Patricia G. Yielding, 5313 Verlinda Dr., Richmond, Va. 23237

[21] Appl. No.: 266,519

[22] Filed: Jun. 28, 1994

[51] Int. Cl.[6] ..... A41B 13/10

[52] U.S. Cl. ..... 2/49.1; 2/49.2; 2/49.3; 2/49.4; 297/182

[58] Field of Search ..... 2/46, 48, 49.1, 2/49.2, 49.3, 49.4, 49.5, 50, 51, 52, 69, 69.5, 75, 80; 297/182, 184.13, 256.15

[56] References Cited

U.S. PATENT DOCUMENTS

| | | | |
|---|---|---|---|
| D. 323,435 | 1/1992 | Palacios . | |
| D. 338,319 | 8/1993 | Bickel . | |
| 590,991 | 10/1897 | Lenhart | 2/49.2 |
| 797,434 | 8/1905 | Homeyer | 2/49.4 |
| 889,073 | 5/1908 | Walbridge | 2/49.4 X |
| 1,108,557 | 8/1914 | Dudley . | |
| 2,362,465 | 11/1944 | Carner | 297/182 |
| 2,377,747 | 6/1945 | Berkowitz | 2/48 |
| 2,532,932 | 12/1950 | Neiswander . | |
| 2,738,511 | 3/1956 | Brady . | |
| 4,231,119 | 11/1980 | Quinn | 2/48 |
| 4,660,225 | 4/1987 | Kahn | 2/49.4 |
| 4,710,979 | 12/1987 | Bull et al. | 2/48 |
| 4,924,528 | 5/1990 | Trombelti-Dickens | 2/48 X |
| 4,946,221 | 8/1990 | Livingston | 297/184.13 |
| 5,056,159 | 10/1991 | Zemke, Jr. . | |
| 5,062,558 | 11/1991 | Stang . | |

FOREIGN PATENT DOCUMENTS

| | | | |
|---|---|---|---|
| 137852 | 5/1948 | Australia | 2/49.3 |

*Primary Examiner*—Jeanette E. Chapman

[57] ABSTRACT

A bib which attaches to a car seat or stroller or, if made to the appropriate size can attach to almost any other chair which has a semi-rigid or rigid bar or shield which extends across the lap of the sitter, such as a wheelchair. The bib protects the sitter's clothing, as well as the car seat and stroller. The bib also serves as a holder and catch for food, toys, and other small objects as the sitter is sitting in the car seat or stroller. The bib is made by any suitable material and can be decorated using appliques or educational toys. The bib can expand to accommodate for the sitter's growth. It can be fastened behind the neck using hook and loop tape, ties, buttons, or snaps. The legs of the bib wrap around the shield or bar of the car seat or stroller using hook and loop tape.

6 Claims, 3 Drawing Sheets

ATTACHABLE BIB, HOLDER, AND CATCH

BACKGROUND OF THE INVENTION

1. Field of the Invention

This invention relates in general to apparel, and in particular to a bib which attaches to the shield or bar of a child's car seat, stroller, or almost any other seat or chair which has a semi-rigid or rigid shield or bar which extends across the lap of the sitter, at a height sufficiently above the sitter's legs to allow adequate clearance and comfort for the sitter's legs.

2. Description of Prior Art

A young child often needs to be fed or entertained by a toy or other small item while sitting in a childs car seat or a stroller that is set in motion. The child may drop the food, toy, or other small item and be unable to retrieve it. Therefore, a tray or some other means for holding and catching the food, toy, or other small item and for preventing it from falling beyond the child's reach would be desirable.

Bib-tray combinations addressing the problem of holding and catching items generally are old in the art. Moreover, some bib-tray combinations have been designed for use with high chairs. None of the bib-tray combinations disclosed in the prior art, however, are designed for use with a seat or chair that, along with the sitter, may be in motion. Specifically, there is no bib-tray combination disclosed in the prior art that can be attached to a child's car seat or stroller and worn by the sitter.

SUMMARY OF THE INVENTION

The present invention is directed to a bib which has a means for holding and catching food, toys or other small items while a child is sitting in a child's car seat, stroller, or any other seat or chair that may set into motion, so long as that seat or chair has a shield or bar extending across the lap of the sitter, at a height sufficiently above the sitter's legs to allow adequate clearance and comfort for the sitter's legs, to which shield or bar the bib is attachable. Although this invention disclosed herein is for a child's use with a child's car seat or stroller, it will be apparent to anyone of ordinary skill in the art that the present invention is adaptable for use by a physically disabled person with a wheelchair that has a shield or bar extending across the sitter's lap.

The bib of the present invention disclosed herein is easily attachable to and removable from either or both the sitter and the child's car seat or stroller. Thus, it can remain attached to the car seat or stroller and does not have to be removed therefrom when the sitter is being put in or taken out. Like other bibs, this bib is made out of any material that is wearable, either washable or disposable, and uniformly flexible. It can accommodate sitters of different sizes.

Not only does the bib of the present invention protect the sitter's clothing and the child's car seat or stroller from spillage of food, it also catches food, toys and other small items, thereby preventing them from accidentally dropping beyond the sitter's reach and/or creating a mess on both the sitter and the car seat or stroller. Like other bibs disclosed in the prior art, this bib can be removably affixed with one or more appliques on its front side for the sitter's educational and recreational use, and fitted with a pocket on its reverse side for storage of the appliques and other small items.

DETAILED DESCRIPTION OF A PREFERRED EMBODIMENT

Figure 1:
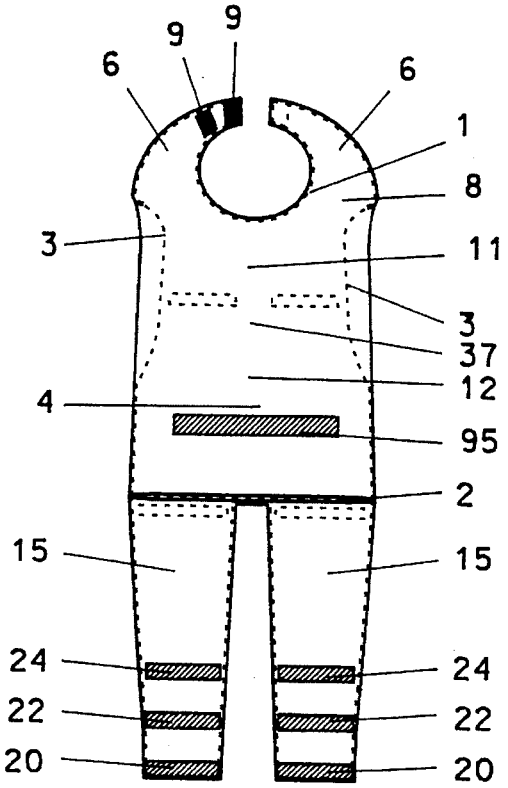
FIG. 1 is the front view of the bib.
Figure 2:
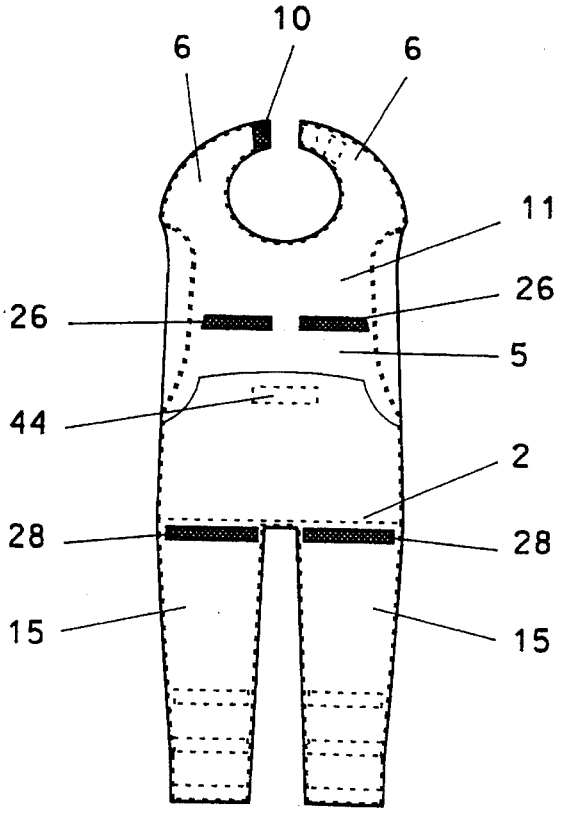
FIG. 2 is the reverse plan view of the bib.

The main body of the bib 37 has generally a neck portion 8, a chest portion 11 and a lap portion 12 that covers the lap of the sitter. It has a bottom edge 2, two side edges 3, a front side 4 facing away from the sitter, and a reverse side 5, as shown in FIG. 2, facing the sitter when the bib is worn. The neck portion 8 consists of two arcuate neck segments 6 having a circular edge 1 that encircles the sitter's neck and opposing strips of hook and loop tape 9 and 10, as shown in FIGS. 1 and 2, such as VELCRO®, affixed to the neck segments 6 such that the neck segments 6 fasten together at a desired point of contact, thereby securing the bib around the sitter's neck. The affixation of more than one strip of hook and loop tape 9 on one of the neck segments 6, as shown in FIG. 1, allows for a variable fit. Although the bib can be fastened around the sitter's neck with buttons, snaps or ties, opposing strips of hook and loop tape are preferred for their safe and easy use.

Figure 6:
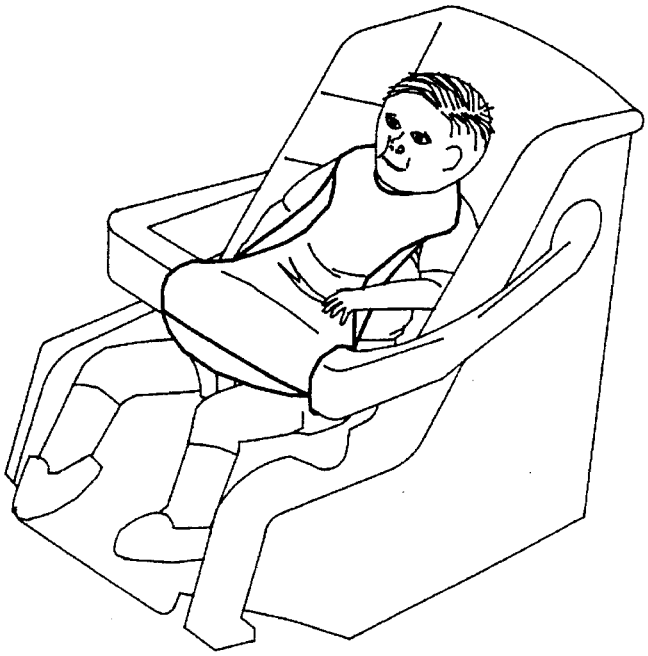
FIG. 6 is the perspective elevational view of an occupied childs car seat with the bib fastened as in normal use.
Figure 7:
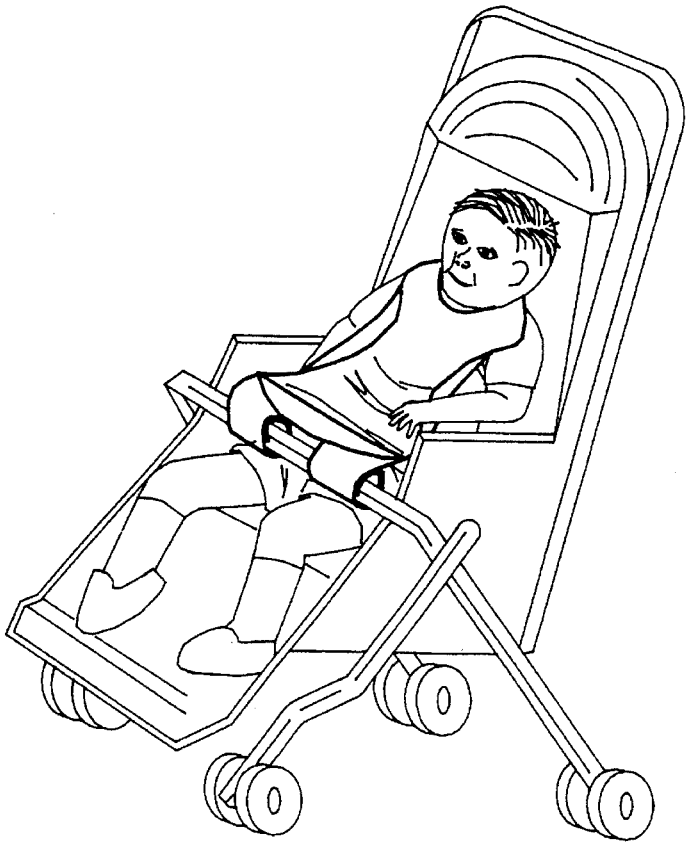
FIG. 7 is the perspective elevational view of an occupied stroller with the bib fastened as in normal use.

The bib of the present invention can be secured to the semi-rigid or rigid shield or back of a child's car seat or stroller, as illustrated in FIGS. 6 and 7, or a shield or bar of any other seat or chair that extends across the sitter's lap at a height sufficiently above the sitter's legs to allow adequate clearance and comfort for the sitter's legs. It is secured by two identical, rectangular leg segments 15 which extend from the main body of the bib 37 at its bottom edge 2. The leg segments 15 each have a plurality of strips of hook and loop tape 20, 22, and 24 affixed at points located distally from the bib's bottom edge 2 on its front side, as shown in FIG. 1, and opposing strips of hook and loop tape 26 and 28, the former being affixed on the bib's reverse side 5 at a point somewhere on the chest portion 11, and the latter pair being affixed at a point on each leg segment 15 located proximally to the bib's bottom edge 2 on its reverse side 5, as shown in FIG. 2. As constructed, the leg segments 15 each wrap over and around the shield or bar of the child's car seat or stroller and fasten at a desired point of contact between a strip of hook and loop tape 20, 22, or 24 and an opposing strip of hook and loop tape 26 or 28, thereby securing the bib to the car seat or stroller. Opposing strip 26 is used if the bib is to be secured to a child's car seat. Opposing strip 28 is used if the bib is to be secured to a stroller. The use of strip 20, 22, or 24 allows for a variable fit.

Figure 3:
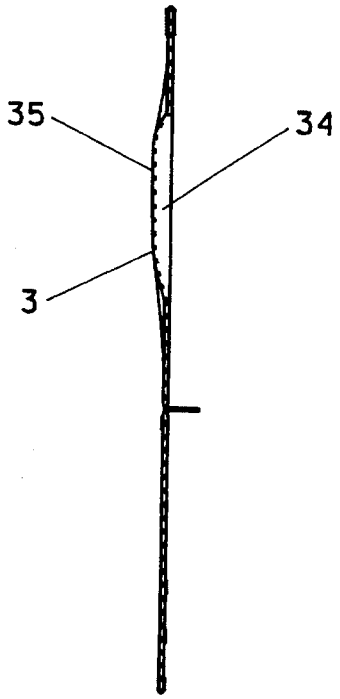
FIG. 3 is the side plan view of the bib.
Figure 4:
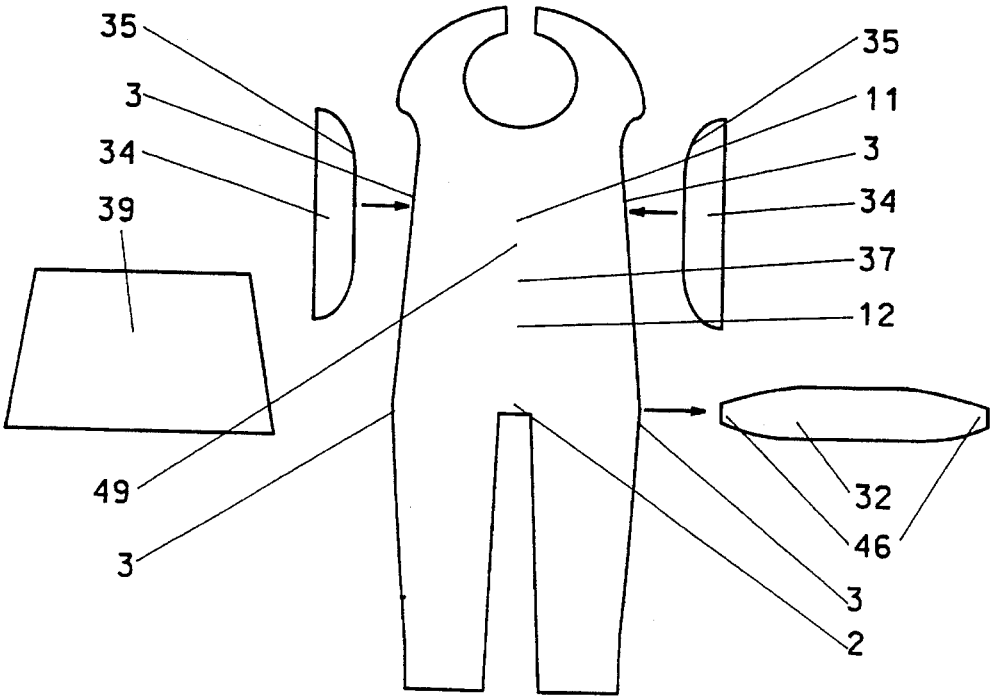
FIG. 4 is the front plan view of the different sections of the bib before they are attached together.

Now refer to FIGS. 3 and 4. The bib has two identical side panels 34 having generally a semi-ellipsoid shape which are attached at their curved edges 35 to the bib's side edges 3 so as to form a gentle trough 49 which slopes downward from the chest portion 11 and bottoms out at the lap portion 12. The trough 49 is of appreciable size for holding and catching food, toys, and other small items. The side panels 34 form the trough's 49 side walls, and a front panel 32 is attached to the bib along its bottom edge 2 and curved around so that its ends 46 attach to the side edges 3 to form a U-shaped front wall for the trough 49 opposite its slope. The walls and the curvature of the trough 49 prevent food, toys, and other small items from falling or dropping to the bottom of the car seat or the stroller, or the ground or floor.

Figure 5:
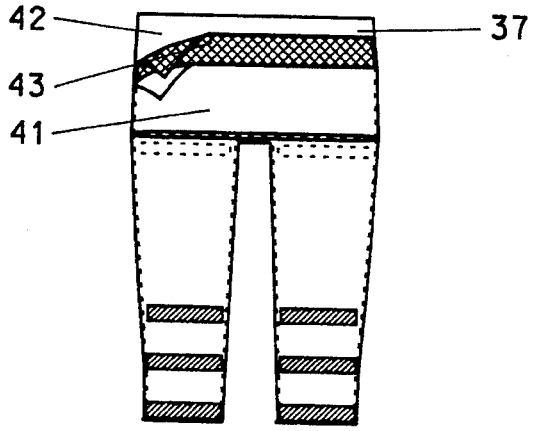
FIG. 5 is the cross section of the main body of the bib.

Although it can be constructed from any flexible material, the preferred embodiment is constructed from cloth fabric, in pieces having the shapes of the main body 37, side panels 34, the front panel 32, and the pocket 39. As shown in FIG. 5, the main body 37 is constructed from two identical pieces of cloth fabric 41 and 42 sewn together at their edges, between which is sandwiched some filler material 43 that is either water-absorbent, such as batting of fleece, or water-proof. In the preferred embodiment, the bib has a pocket 39 which is attached on its reverse side 5 contiguous with the lap portion 12 and is closed using opposing strips of hook and loop tape 44, as shown in FIG. 2. The bib is also decorated with appliques of a variety of shapes, colors, patterns, textures, and symbols (not shown in the drawings), which are removably attached to the bib by the use of opposing strips of hook and loop tape affixed to the bib's front side, as illustrated by a strip of hook and loop tape 95 on FIG. 1, and to the reverse sides of the appliques. The appliques are stored in the pocket 39 when not in use.

FIGS. 6 and 7 illustrate the preferred embodiment, as it is used with a child's car seat and a stroller.

The invention claimed is:

1. A bib for holding and catching items, such as food and toys, attachable to a seat or chair having a semi-rigid or rigid shield or bar extending across a sitter's lap at a height sufficiently above the sitter's legs to allow adequate clearance and comfort for the sitter's legs, the bib having (a) generally a neck portion, a chest portion, a lap portion, and a bottom edge, two side edges, a front side facing away from the sitter and a reverse side facing the sitter when the bib is worn, (b) two identical side panels each having generally a semi-ellipsoid shape, attached at their curved edges to the bib along the side edges so as to form a walled, gentle trough in the front side of the bib which slopes downward from the chest portion and bottoms out at the lap portion, (c) a front panel having generally a rectangular shape, attached to the bib along the bottom edge, curved around such that its ends are attached to the side edges, so as to form a U-shaped front wall for the trough opposite its slope, (d) the neck portion comprising of two arcuate neck segments having a fastening means to secure the bib around the sitter's neck, and (e) two identical rectangular leg segments extending away from the bottom edge of the bib and each leg segment having a fastening means to secure any one of a plurality of points located distally from the bottom edge on one side of the leg segment to a point located either proximally to the bottom edge on the reverse side of the leg segment or somewhere on the chest portion on the bib's reverse side, such that the leg segments wrap around the shield or bar securely to attach the bib to the seat or chair, and the bib being constructed of a flexible material and of sufficient length to be comfortably worn by the sitter when the sitter is seated and the bib is attached to the seat or chair.

2. The bib of claim 1, wherein the fastening means used to secure the leg segments of the bib to the shield or bar of the seat or chair comprises of a plurality of strips of hook and loop tape arranged on and affixed to the front side of each leg segment at points located distally from the bib's bottom edge and three opposing strips of hook and loop tape, two strips being arranged on and affixed to the reverse side of each leg segment at a point located proximally to the bib's bottom edge, and another strip to the reverse side of the bib a point located somewhere on the chest portion.

3. The bib of claim 1 or 2, wherein the fastening means used to secure the bib around the sitter's neck comprises of a plurality of opposing strips of hook and loop tape affixed to opposite sides of the two arcuate neck segments.

4. The bib of claim 1 or 2, wherein the flexible material from which the bib is constructed is cloth fabric, one sheet of fabric forming the front side of the bib and another sheet of fabric of the same areal dimensions as the first sheet forming the reverse side of the bib, the two sheets of fabric being sewn together, with a filler material such as batting or fleece sandwiched between the two sheets of fabric.

5. The bib of claim 1 or 2, wherein the bib has a pocket on the reverse side of the bib.

6. The bib of claim 1 or 2, wherein the bib has a plurality of strips of hook and loop tape arranged on and affixed to the front side of the bib to which appliques of a variety of shapes, colors, patterns, textures, and symbols, having opposing strips of hook and loop tape, can be attached.

* * * * *